US006038783A

United States Patent [19]

McFadden

[11] Patent Number: 6,038,783

[45] Date of Patent: Mar. 21, 2000

[54] SUPPORT HARNESS FOR A HARD SHELLED HAIR DRYER

[76] Inventor: Lynette McFadden, 1116 Lindley Ave., Philadelphia, Pa. 19141

[21] Appl. No.: 09/288,562

[22] Filed: Apr. 9, 1999

[51] Int. Cl.[7] ..... A45D 20/00

[52] U.S. Cl. ..... 34/99

[58] Field of Search ..... 34/90, 91, 96, 34/97, 98, 99; 392/380, 383, 384

[56] References Cited

U.S. PATENT DOCUMENTS

| | | | |
|---|---|---|---|
| 2,466,915 | 4/1949 | Shields | 34/99 |
| 3,108,862 | 10/1963 | Toulmin | 34/99 |
| 3,377,715 | 4/1968 | Hubner | 34/99 |
| 3,946,498 | 3/1976 | Waters et al. | 34/90 |
| 3,983,638 | 10/1976 | Magid | 34/90 |
| 4,038,759 | 8/1977 | Dyer et al. | 34/99 |
| 4,361,966 | 12/1982 | Downey | 34/99 |
| 4,384,411 | 5/1983 | Stiegler et al. | 34/99 |
| 5,651,190 | 7/1997 | Sanders | 34/99 |
| 5,787,601 | 8/1998 | Stelly | 34/99 |

*Primary Examiner*—Pamela A. Wilson
*Attorney, Agent, or Firm*—Wenderson & Sturm LLP

[57] ABSTRACT

A hard-shelled portable hair drying apparatus 10 including a hood unit 11 including a generally rigid hood member 20 having an upper portion 21 and a lower portion 23 divided by an apertured partition 26; wherein, at least a portion of a drying unit 12 is disposed in the upper portion 21 of the hood member 20 which is further provided with a three-point support unit 13 which includes a pair of shoulder engaging support members 40 and a relatively elongated third support member 50 which is operatively associated with the user's back and upper torso.

10 Claims, 1 Drawing Sheet

SUPPORT HARNESS FOR A HARD SHELLED HAIR DRYER

BACKGROUND OF THE INVENTION

1. Field of the Invention

The present invention relates to the field of portable hair dryers in general and in particular to a support harness to maintain a hard shell type hair dryer in an upright position.

2. Description of Related Art

As can be seen by reference to the following U.S. Pat. Nos. 3,377,715; 4,361,966; 4,384,411; 5,651,190; and 5,787,601, the prior art is replete with myriad and diverse portable hair dryer devices that employ a lightweight flexible hood member.

While all of the aforementioned prior art constructions are more than adequate for the basic purpose and function for which they have been specifically designed, they are uniformly deficient with respect to their failure to provide a simple, efficient, and practical arrangement for supporting a relatively heavy hard shell type hair drying hood in a surrounding relationship with the user's head while still maintaining the portability of the hair dryer.

As most hair care specialists are all too well aware, the stationary hard shell type hair dryers offer significant advantages over virtually all of the portable hair dryers which employ an inflatable and/or lightweight hood in that the hard shell hoods produce a faster and more uniform drying of the user's hair.

As a consequence of the foregoing situation, there has existed a longstanding need for a new and improved type of portable hair dryer employing a relatively heavy hard shell type hood member and the provision of such a construction is the stated objective of the present invention.

BRIEF SUMMARY OF THE INVENTION

Briefly stated, the portable hair dryer arrangement that forms the basis of the present invention comprises in general a hood unit, a dryer unit, and a support unit.

As will be explained in greater detail further on in the specification, the hood unit comprises a relatively heavy hard shelled style hood member having an upper portion and a transparent lower portion divided by an interior apertured partition wherein at least a portion of the dryer unit which includes a heating coil member, a fan member and a power source is contained within the upper portion of the hood member.

In addition, a three-point support unit forms the heart of this invention and includes a pair of shoulder engaging support members that prevents the lateral displacement of the hood member relative to the user's head and a relatively elongated third support member which is operatively associated with the user's back and upper torso to prevent the front to back displacement of the hood member relative to the user's head.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
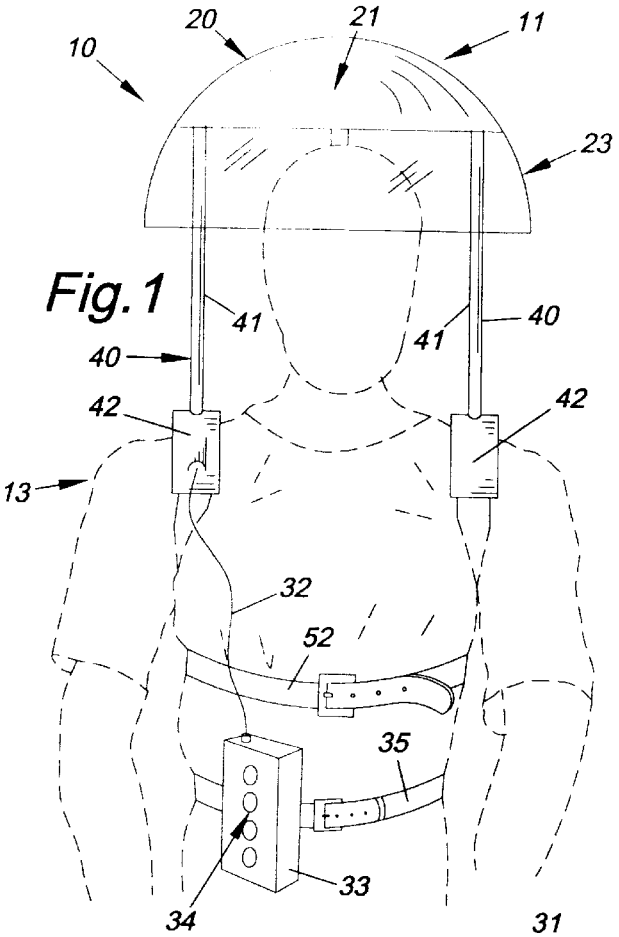
FIG. 1 is a front perspective view of the portable hair drying apparatus that forms the basis of the present invention in use.

As can be seen by reference to the drawings, and in particular to FIG. 1, the portable hair drying apparatus that forms the basis of the present invention is designated generally by the reference number 10. The apparatus 10 comprises in general a hood unit 11, a dryer unit 12, and a support unit 13. These units will now be described in seriatim fashion.

Figure 2:
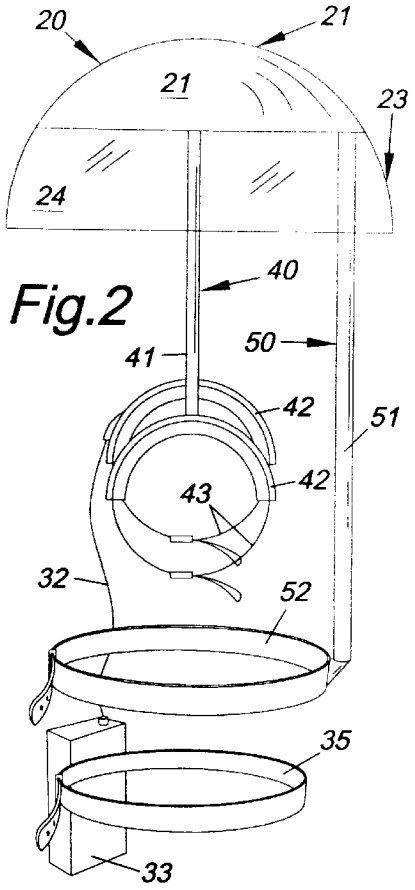
FIG. 2 is an isolated side perspective view of the hair drying apparatus; and, FIG. 3 is a partial cross-sectional view showing the interior of the hood unit.
Figure 3:
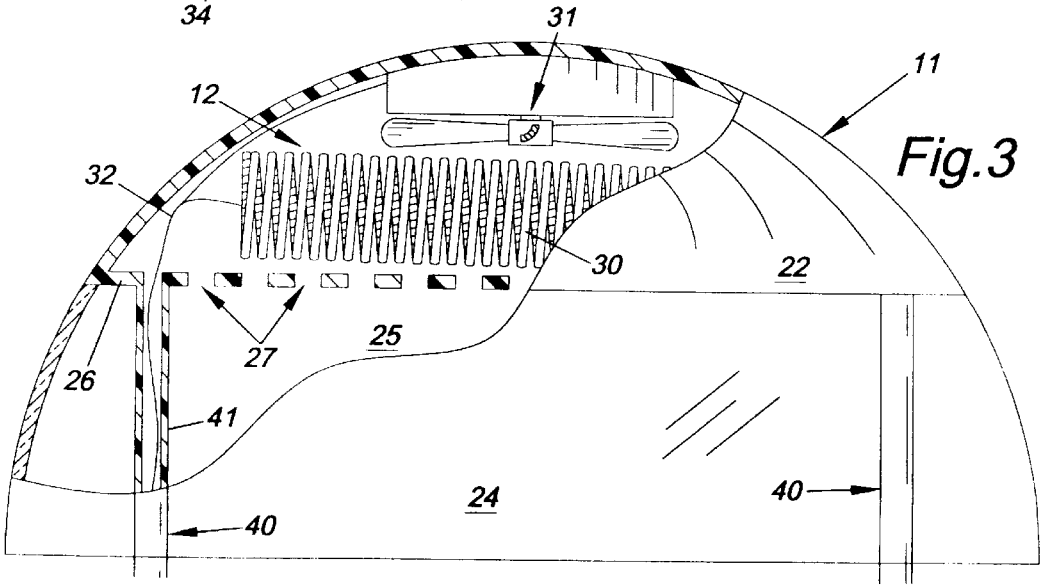

As can be seen by reference to FIGS. 1 through 3, the hood unit 11, comprises a hard shell type hood member 20, having a quasi-hemispherical configuration wherein the upper portion 21 of the hood member 20 is fabricated from a hard, generally opaque plastic material 22. The lower portion 23 of the hood member 20 is fabricated from a generally transparent plastic material 24; and, the interior 25 of the hood member 20 is provided with an apertured partition 26 which delineates the transition of the upper portion 21 from the lower portion 23; wherein, the partition 26 is further provided with a plurality of apertures 27 whose purpose and function will be described in greater detail further on in the specification.

As can best be seen by reference to FIG. 3, the dryer unit 12 comprises a heating coil member 30 suspended within the upper portion 21 of the hood member 20 proximate to the plurality of apertures 27 in the partition 26 and a fan member 31 suspended in the upper portion 21 of the hood member 20 at a point above the heating coil member 30 for forcing heated air downwardly through the apertures 27 and into the lower portion 23 of the hood member 20 for the purpose of drying the user's hair.

Returning once more to FIGS. 1 through 3, it can be seen that both the fan member 31 and the heating coil member 30 are electrically coupled to a power source 33 via an electrical cord 32 wherein power source 33 also has a plurality of control knobs 34 which govern the operation, duration, and temperature of the dryer unit 12 in a well-recognized fashion.

Still referring to FIGS. 1 through 3, it can be seen that the support unit 13 comprises a pair of shoulder support members 40 wherein each support member 40 includes a vertical support rod element 41 having an upper end connected to the apertured partition 26; and, having a lower end provided with a generally C-shaped padded shoulder engaging element 42 which is further provided with an adjustable tether element 43.

In addition, the support unit 13 also comprises a back support member 50 which includes an elongated vertical support rod element 51 having an upper end connected to the apertured partition 26 of the hood member 20 and having a lower end provided with an adjustable strap element 52 which is dimensioned to encircle a portion of the user's torso.

At this juncture, it should be noted that in the preferred embodiment of the invention illustrated in FIGS. 1 and 2, the power source 33 is provided with its own strap element 35 primarily due to the anticipated weight of the power source 33. However, it is to be understood that it is in keeping with the teachings of this invention to attach the power source 33 directly to the strap element 62 if so desired.

In addition, as suggested in FIGS. 1 through 3, the electrical wiring 32 may be threaded through one of the hollow support rod elements 41 and its associated shoulder engaging element 42.

By now, it should be appreciated that due to the weight of the hood unit 11 and the heating coil member 30 and fan member 31 which are contained within the upper portion 21 of the hood member 20, it is necessary to provide a fairly substantial support unit 13 to make the hair dryer apparatus 10 truly portable.

It should also be appreciated that it is necessary to provide a through point support unit 13 wherein at least two of the support members 40 are operatively associated with the user's shoulders to prevent side-to-side tipping of the hood member 20.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A portable hair drying apparatus comprising:

a hood unit including a hard-shelled hood member having generally rigid upper and lower portions, a front, a back, and opposed sides;

a three-point support unit including a pair of support members connected to the opposed sides of the hood member and operatively associated with the shoulders of a user of the hair drying apparatus, and a third support member connected to the back of the hood member and associated with the upper torso of a user of a hair drying apparatus; and, a dryer unit operatively associated with the hood unit and including a heating coil member, a fan member, and a power source provided with control knobs.

2. The apparatus as in claim 1; wherein each one of said pair of support members includes a support rod element having a lower end provided with a generally C-shaped shoulder engaging element.

3. The apparatus as in claim 2 wherein each of the shoulder engaging elements are padded.

4. The apparatus as in claim 2; wherein, the third support member includes a relatively elongated support rod element wherein a portion of the elongated support rod element is provided with an adjustable strap element.

5. The apparatus as in claim 4; wherein, the elongated support rod element has a lower end provided with an adjustable strap element.

6. The apparatus as in claim 4; wherein, the interior of the hood member has an apertured partition that delineates the upper portion of the hood member from the lower portion of the hood member.

7. The apparatus as in claim 6; wherein, at least a portion of the drying unit is disposed in the upper portion of the hood member.

8. The apparatus as in claim 6; wherein, the heating coil member is disposed in the upper portion of the hood member.

9. The apparatus as in claim 8; wherein, the fan member is disposed in the upper portion of the hood member.

10. The apparatus as in claim 6; wherein, at least a part of the lower portion of the hood member is fabricated from a transparent material.

* * * * *